US006488526B2

(12) United States Patent
Ruiz et al.

(10) Patent No.: US 6,488,526 B2
(45) Date of Patent: Dec. 3, 2002

(54) INSULATION-DISPLACEMENT CONNECTING PIECE ABLE TO BE CONNECTED TO AN ADJACENT CONNECTING PIECE

(75) Inventors: Ariel Ruiz, Villeurbanne (FR); Sylvain Barrat, Belleville sur Saone (FR)

(73) Assignee: Entrelec S.A., Lyons (FR)

( * ) Notice: Subject to any disclaimer, the term of this patent is extended or adjusted under 35 U.S.C. 154(b) by 0 days.

(21) Appl. No.: 09/748,193

(22) Filed: Dec. 27, 2000

(65) Prior Publication Data

US 2001/0027050 A1 Oct. 4, 2001

(30) Foreign Application Priority Data

Jan. 4, 2000 (FR) ..... 00 00066

(51) Int. Cl.[7] ..... H01R 4/24
(52) U.S. Cl. ..... 439/406
(58) Field of Search ..... 439/709, 404, 439/406, 511, 507, 509, 508, 512, 513, 395, 922, 923

(56) References Cited

U.S. PATENT DOCUMENTS 4,043,628 A * 8/1977 Narozny ..... 439/397
4,283,103 A * 8/1981 Forberg et al. ..... 439/188
4,822,306 A * 4/1989 Klaiber ..... 439/709
4,851,967 A * 7/1989 Gerke et al. ..... 361/823
5,641,312 A * 6/1997 Bippus et al. ..... 439/709

FOREIGN PATENT DOCUMENTS

| | | | |
|---|---|---|---|
| DE | 299 10 867 U | 9/1999 | |
| EP | 0 109 297 A | 5/1984 | |
| EP | 0 117 021 A | 8/1984 | |
| EP | 0 247 360 A | 12/1987 | |

* cited by examiner

*Primary Examiner*—Brian Sircus
*Assistant Examiner*—Phuong KT Dinh
(74) *Attorney, Agent, or Firm*—Oliff & Berridge, PLC

(57) ABSTRACT

Piece with a profiled shape having a hollow polygonal section along which an insulation-displacement and retaining slit for at least one wire is made. One face of the polygonal section is extended as a lug and curved toward the connecting piece, leaving a space intended to take a prong of an interconnection comb between the curved lug and the connecting piece. A connecting device comprising the piece, and an insulating casing.

20 Claims, 2 Drawing Sheets

INSULATION-DISPLACEMENT CONNECTING PIECE ABLE TO BE CONNECTED TO AN ADJACENT CONNECTING PIECE

The present invention relates to an insulation-displacement connecting piece able to be electrically connected to an adjacent connecting piece.

BACKGROUND OF THE INVENTION

In the field of electrical connection apparatus, it is known practice to place electrical components, for example, junction blocks, next to each other, aligned. It is thus common to align a series of identical junction blocks on one and the same rail.

It is also known practice to interconnect electrical components such as junction blocks aligned next to each other. These electrical components generally comprise a host structure which may be formed by a female piece specifically designed to take a type of clip. Use is then made of a device called an interconnection comb which comprises several clips next to each other and electrically connected together. The comb is then plugged into the host structures for the aligned electrical components.

Where blocks for sensors/actuators are aligned on one and the same assembly rail, an interconnection has to be made between all the blocks in order to have a common electrical reference. There are therefore various solutions to ensure an electrical contact with an adjacent block.

DESCRIPTION OF THE PRIOR ART

One solution consists in providing each block on one face with a female connector and on its opposite lateral face with a male connector. Thus, by aligning the blocks next to each other, each male pin sits in a female connector, thus creating electrical continuity between the aligned blocks.

Another solution consists in assembling the various blocks on a base containing a rail which has been overmolded. An electrical connection with the overmolded rail is then provided at each block mounted on this base. A common potential is thus obtained for all of the aligned blocks.

These solutions of the prior art are all made with connections of the spring or screw type and are not designed for insulation-displacement connections.

However, application EP-0 109 297 has proposed an insulation-displacement connection block. Inside this block is placed a connecting piece which comprises a part in a profiled shape having a hollow rectangular section with two large faces and two small faces. One insulation-displacement slit for taking at least one wire is made along the two opposite small faces. Finally, the connecting piece has two lugs made in the extension of the two small faces and curved toward the inside of the polygonal part to allow the connection of a prong of an interconnection comb and a lug made in the extension of the large face and curved toward the small faces so as to define a space intended to take the prong of an interconnection comb.

Such a connecting piece does actually allow the use of an interconnection comb but has the drawback of having a structure which is complex and expensive to manufacture and of a relatively large size.

The need to have an insulation-displacement connecting piece which is of a smaller size and which has a low manufacturing cost is therefore apparent.

SUMMARY OF THE INVENTION

Thus, the object of the present invention is to provide an insulation-displacement connection terminal which can be easily connected to an adjacent connection terminal of the same type. This connection terminal will preferably be of minimal size.

For this purpose, the invention proposes an insulation-displacement connecting piece comprising a part in a profiled shape having a hollow polygonal section along which an insulation-displacement and retaining slit for at least one wire is made.

According to the invention, one face of the polygonal section is extended by a lug curved toward the connecting piece, leaving a space intended to take a prong of an interconnection comb between the curved lug and the connecting piece.

This solution means that it is possible to make a connecting piece which can be easily connected to an adjacent piece. Furthermore, it can be made with a small size while having a structure which is simple and easy to manufacture.

The face of the profile carrying the curved lug is preferably the face opposite to the insulation-displacement and retaining slit. However, it is possible to choose another face of the profile.

In a first embodiment, the lug is curved by about 90° to face a section of the profile. This is either the section of the profile through which a wire to be connected is introduced, or the section opposite thereto. In order not to interfere with the introduction of the wire, the lug is chosen to be placed on the side opposite the side intended for the introduction of the wire. However, if a lower height is required, the other solution may be adopted.

To encourage a better electrical contact and to guarantee that there is an area of contact between an interconnection device and the connecting piece, the faces of the profile not carrying the edges of the insulation-displacement and retaining slit and not carrying the curved lug have, for example, a recess on the side by the curved lug. The contact is then made at the faces of the connecting piece carrying the edges of the insulation-displacement and retaining slit.

In another embodiment, the lug is, for example, curved by about 180° to face the face of the profile which carries it.

To encourage a better electrical contact, the curved lug advantageously has, close to its free end, a boss projecting toward the connecting piece.

To encourage the introduction of a prong of an interconnection comb between the curved lug and the connecting piece, the free end of the curved lug is advantageously inclined with respect to the general direction of the lug and away from the connecting piece.

The present invention also relates to a connecting device for at least one wire, comprising a conducting connecting piece with an insulation-displacement and retaining slit and an insulating casing having a housing in which the conducting connecting piece is immobilized, and provided, on the one hand, with a substantially parallel oblong opening situated facing the slit and, on the other hand, with an opening which is possibly coincident with the oblong opening, intended for the passage of a prong of an interconnection comb, wherein the conducting connecting piece is a connecting piece as described above.

In this connecting device, the casing additionally comprises, for example, an opening made in the extension of the profiled part of the connecting piece intended for the passage of the end of an external tool designed to enable a wire to be introduced into the insulation-displacement and retaining slit. A connection can then be made using a tool as described, for example, in document EP-0 265 321.

BRIEF DESCRIPTION OF THE DRAWINGS

In any case, the invention will be better understood using the following description, with reference to the appended schematic drawings showing by way of nonlimiting examples, two embodiments of a connection terminal according to the invention.

DESCRIPTION OF THE PREFERRED EMBODIMENTS

Figure 1:
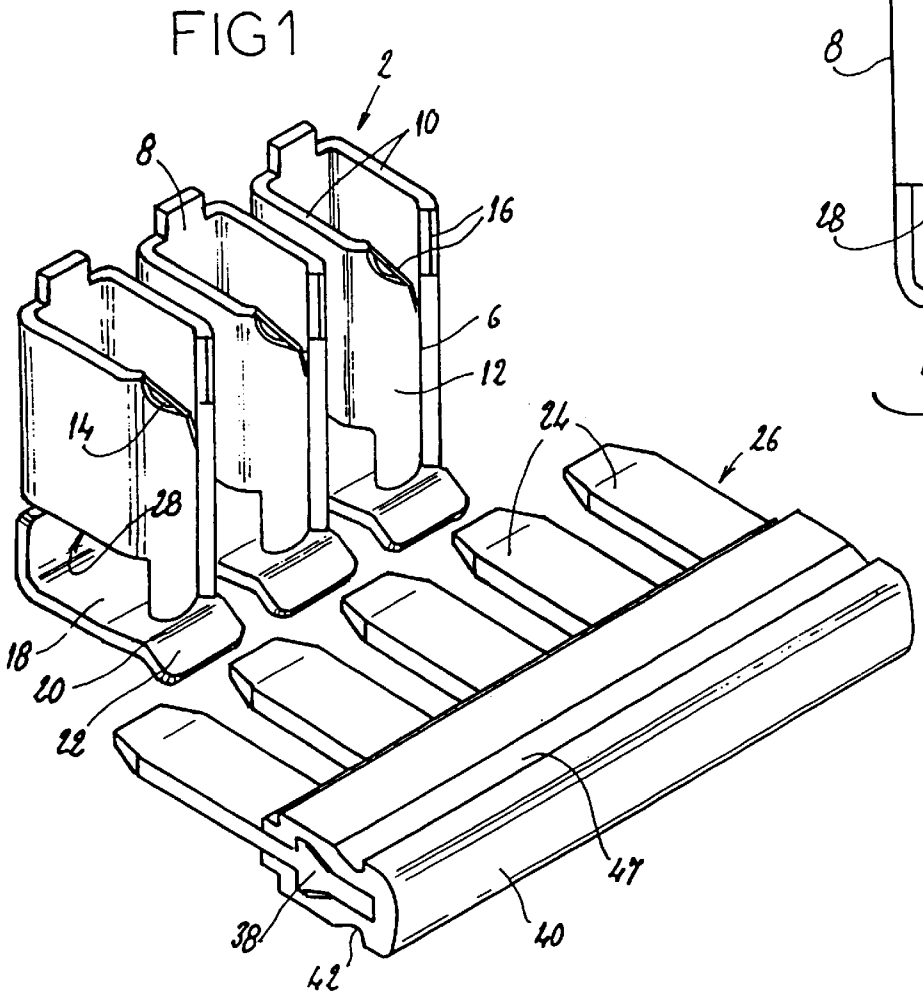
FIG. 1 is a perspective view of three terminals according to the invention and of an interconnection comb.

FIG. 1 shows three connecting pieces placed next to each other of the same type as those described, for example, in document EP-0 247 360.

Each of these connecting pieces 2 is intended to be incorporated into electrical equipment to connect one or more wires (not shown). These pieces 2 are immobilized conventionally in a housing provided for this purpose in a casing 4 (FIG. 3) for electrical equipment, which is, for example, formed by an assembly of two complementary half shells welded together, for example by ultrasonic welding, after the introduction of various components, such as conducting connecting pieces.

Each connecting piece 2 is a profiled piece and comprises an insulation-displacement and retaining slit 6 which here is straight and parallel to the longitudinal axis of the corresponding profiled connecting piece 2. Such a piece is, for example, obtained from a flat blank stamped to produce a cutout, then folded and possibly thinned locally.

Each connecting piece 2 here has a hollow polygonal section which corresponds to a U comprising a base 8 and two branches 10, the free ends of which have been obliquely and evenly folded one toward the other. The free end of each folded part 12 forms one edge of the insulation-displacement and retaining slit 6. These parts 12 are possibly gradually thinned toward the slit 6.

The slit 6 has an insulation-displacement mouth 14 made at one of its ends. This mouth 14 is obtained by symmetrically cutting the folded parts 12 obliquely at one of their ends. This insulation-displacement mouth 14 is flared and has two sharp edges 16, one at each oblique cut. The folded parts 14 are gradually thinned toward the sharp edges 16 so as to enable them to cut into the sheath of a wire introduced into the slit 6.

The base 8 is extended at the opposite end from the mouth 14, by a lug 18, folded at 90°. If it is assumed that the axis of the profiled piece is vertical and that the mouth 14 lies on the top part of the profiled piece, then the lug 18 extends under the connecting piece 2. It extends over virtually the entire length of this piece 2. Even with the folded parts 12, the lug 18 has a boss 20 which projects toward the connecting piece 2. The free end 22 of the lug 18 is inclined with respect to the direction of extension of the lug 18 and away from the connecting piece 2. This slope is intended to facilitate the introduction into the free space left between the lug 18 and the connecting piece 2 of a prong 24 of an interconnection comb 26.

In order to guarantee a good contact between the connecting piece 2 and the prong 24 of the interconnection comb 26, the lower end of the branches 10 has a recess 28 to prevent contact between the lower edge of the branches 10 and the prong 24.

Figure 3:
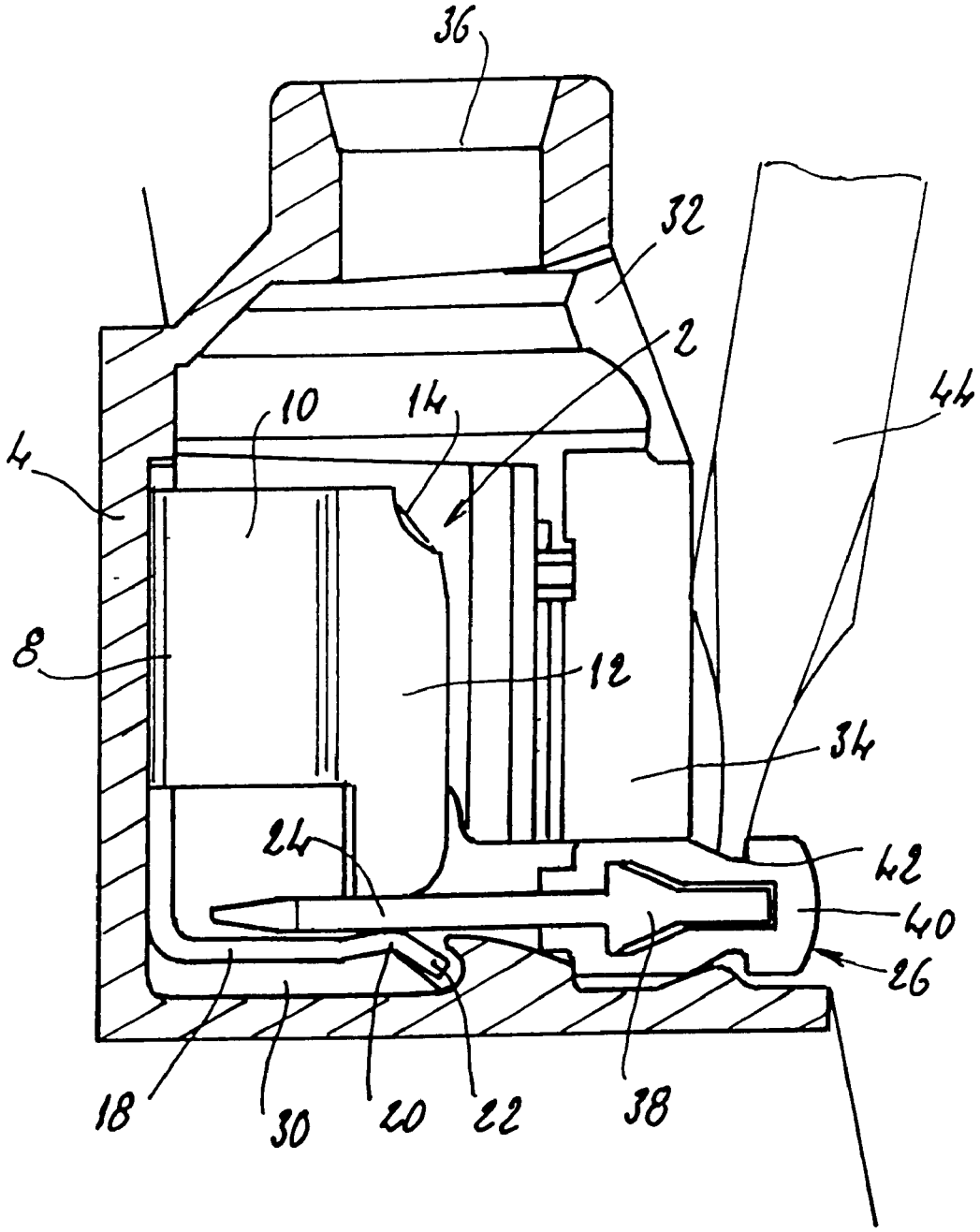
FIG. 3 is a sectional view showing from the side the assembly of FIGS. 1 and 2 mounted in a junction block.

As shown in FIG. 3, the casing 4, made from a synthetic insulating material, has a housing 30 for a connecting piece 2. It also has an orifice 32 in order to allow a wire to be introduced from outside the box toward the mouth 14 of the corresponding connecting piece 2. This orifice 32 is located above the connecting piece 2 and is extended downward by a slit 34 which extends substantially parallel to and facing the slit 6 of the connecting piece 2. The slit 34 is long enough to also allow the introduction of a prong 24 between the lug 18 and the connecting piece 2. The casing 4 also comprises an opening 36 intended for the passage of an end of a tool for introducing the wire into the slit 6. This opening 36 is placed in the extension of the profiled part of the connecting piece 2 and on the same side as the insulation-displacement mouth 14. It is intended for the passage of an end of a tool, not shown and not described in detail here. Reference may be made to patent EP-0 247 360 or EP-0 265 321 for the description of the tool and of its end. The shape of the opening 36 is adapted to the shape of the end of the tool.

In the embodiment shown in FIG. 3, the insulating casing 4 is mounted on a block for a sensor/actuator. For such blocks, it is always necessary, at least for a connecting piece, to make an interconnection with a connecting piece of an adjacent block. Thus the interconnection comb 26 is used.

The interconnection comb 26 comprises prongs 24 which all lie parallel to each other and which are spaced at a pitch corresponding to the pitch of the aligned connecting pieces 2 mounted next to each other. The prongs 24 are made from a metal and are connected to each other by a metal base 38 made from the same material. This base is fitted into an insulating sheath 40. This sheath 40 is a profiled piece made from a synthetic material and having a generally U-shaped section. The base 38 of the interconnection comb 26 is housed between the branches of the U of the sheath 40. These two pieces are mounted by sliding the base 38 into the sheath 40 and are held together by compatibility of shapes. In addition, the sheath 40 has longitudinal grooves 42, 47 extending along each external face of the branches of the U. As can be seen in FIG. 3, these grooves 42, 47 provide purchases for a tool, in this case the end of a blade 44 of a screwdriver. The removal of the interconnection comb is made easier by the presence of these grooves 42, 47.

In FIG. 3, the interconnection comb 26 is engaged in contact with the connecting piece 2. The corresponding prong 24 is gripped between the lower parts of the folded parts 12 of the connecting piece 2 and the boss 20 of the lug 18. Folding the lug 18 gives it a certain degree of elasticity. It can therefore be contrived that at rest the space between the connecting piece 2, or more precisely the lower edge of the folded part 12 and the boss 20 is less than the thickness of a prong 24. In this way, the lug 18 exerts an elastic contact force on the prong 24 in the direction of the connecting piece. Thus, better electrical contact is achieved.

Figure 4:
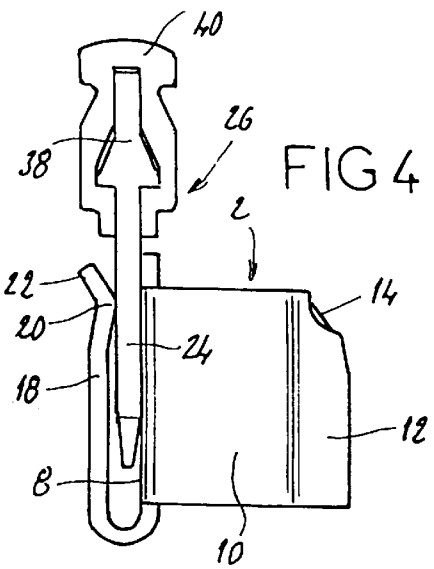
FIG. 4 is a view corresponding to FIG. 2 for an alternative embodiment.

FIG. 4 shows an alternative embodiment of a connecting piece 2. Once again there is a connecting piece of the same type as that described above. This connecting piece is also a profiled piece having a polygonal section and slit longitudinally. On the side opposite to the slit, the connecting piece has a base 8 to which are attached two lateral branches 10, the free ends of which are folded, thus forming folded parts delimiting the slit of the connecting piece on each side.

Figure 2:
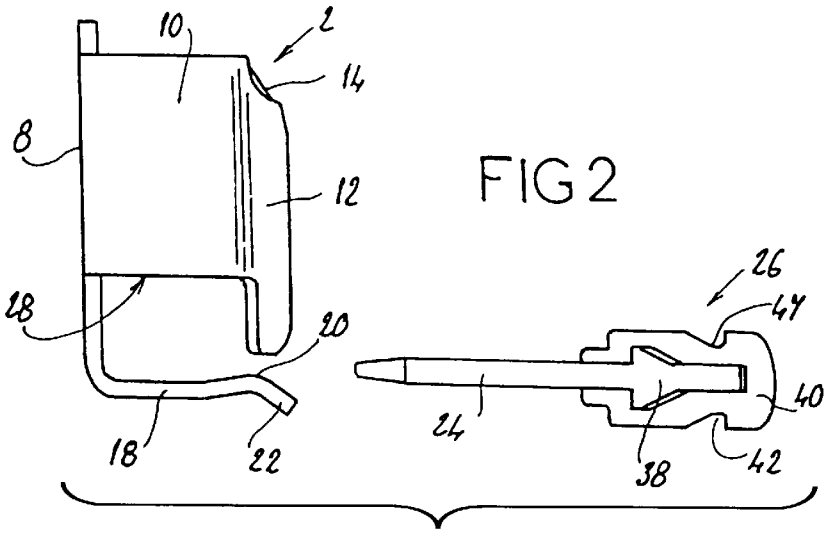
FIG. 2 is a side view of the assembly shown in FIG. 1.

In this case, there is no recess 28 in the branches 10 of the connecting piece. However, there is still a lug 18 which extends the base on the side opposite the mouth 14 of the slit. The difference here, with respect to the embodiment of FIGS. 1 to 3, is that the lug 18 is folded by about 180° and in the opposite direction to the fold previously described. The lug 18 here extends substantially parallel to the base 8. This lug 18 extends virtually over the whole height of the profiled piece 2. As described previously, it comprises a boss 20 and a free end 22 inclined away from the connecting piece 2.

Whereas in the first embodiment the prongs 24 of the interconnection comb extend virtually parallel to a connected wire, here the prongs 24, in the connected position, extend substantially perpendicular to a connected wire and parallel to the insulation-displacement and retaining slit of the connecting piece 2. This alternative embodiment of FIG. 4 allows the introduction of the interconnecting comb 2 via a face of the casing 4 other than that via which the interconnection comb 26 is introduced for the embodiment of FIGS. 1 to 3. In this case, the prongs 24 of the interconnection comb sit along the base 8 of the connecting piece 2. As described previously, a space smaller than the thickness of a prong 24 is preferably left between the base 8 and the boss 20 when the connecting piece is at rest and is not connected to an adjacent connecting piece. In this way, the lug 18 then exerts an elastic contact force on the prong 24, encouraging better electrical contact.

It goes without saying that the invention is not limited to the two preferred embodiments described above by way of nonlimiting example; on the contrary, it covers all variants within the scope of the claims below.

Thus, for example, the folded lug does not have to begin at the base of the profiled piece or even at the face opposite the insulation-displacement slit. It is possible to have a lug extending from a lateral face of the profiled piece. However, this embodiment has not been described since it has some drawbacks with respect to the embodiments described above. This is because, with such a connecting piece, one would have either a greater width or a folded lug having an elasticity which was less than that of the lugs described above.

The folded lug does not have to start at the side opposite to the mouth for introducing the wire. In the variant of FIGS. 1 to 3, it is possible to imagine a lug folded upward, extending from the base of the profiled piece. One could then make use of the opening allowing the introduction of a wire, to also achieve the interconnection of several connecting pieces.

What is claimed is:

1. An insulation-displacement connecting piece comprising a part in a profiled shape having a hollow polygonal section along which an insulation displacement and retaining slit for at least one wire is made longitudinally, wherein one face of the polygonal section opposite to the insulation-displacement and retaining slit is extended as a lug and curved toward the connecting piece, leaving a space intended to take a prong of an interconnection comb between the curved lug and the connecting piece.

2. The connecting piece as claimed in claim 1, wherein the lug is curved by about 90° to face a section of the profile.

3. The connecting piece as claimed in claim 2, wherein the faces of the profile not carrying the edges of the insulation-displacement and retaining slit and not carrying the curved lug have a recess on the side by the curved lug.

4. The connecting piece as claimed in claim 1, wherein the lug is curved by about 180° to face the face of the profile which carries it.

5. The connecting piece as claimed in claim 1, wherein the curved lug has, close to its free end, a boss projecting toward the connecting piece.

6. The connecting piece as claimed in claim 1, wherein the free end of the curved lug is inclined with respect to the general direction of the lug and away from the connecting piece.

7. A connecting device for at least one wire, comprising a conducting connecting piece with the insulation-displacement and retaining slit and an insulating casing having a housing in which the conducting connecting piece is immobilized, and provided, on the one hand, with a substantially parallel oblong opening situated facing the slit and, on the other hand, with an opening which is at least one of coincident or not coincident with the oblong opening, intended for the passage of a prong of an interconnection comb, wherein the conducting connecting piece is a connecting piece as claimed in claim 1.

8. The connecting device as claimed in claim 7, wherein the casing further comprises an opening made in the extension of the profiled part of the connecting piece intended for the passage of the end of an external tool designed to enable a wire to be introduced into the insulation-displacement and retaining slit.

9. The connecting piece as claimed in claim 2, wherein the curved lug has, close to its free end, a boss projecting toward the connecting piece.

10. The connecting piece as claimed in claim 3, wherein the curved lug has, close to its free end, a boss projecting toward the connecting piece.

11. The connecting piece as claimed in claim 4, wherein the curved lug has, close to its free end, a boss projecting toward the connecting piece.

12. The connecting piece as claimed in claim 2, wherein the free end of the curved lug is inclined with respect to the general direction of the lug and away from the connecting piece.

13. The connecting piece as claimed in claim 3, wherein the free end of the curved lug is inclined with respect to the general direction of the lug and away from the connecting piece.

14. The connecting piece as claimed in claim 4, wherein the free end of the curved lug is inclined with respect to the general direction of the lug and away from the connecting piece.

15. The connecting piece as claimed in claim 5, wherein the free end of the curved lug is inclined with respect to the general direction of the lug and away from the connecting piece.

16. A connecting device for at least one wire, comprising a conducting connecting piece with an insulation-displacement and retaining slit and an insulating casing having a housing in which the conducting connecting piece is immobilized, and provided, on the one hand, with a substantially parallel oblong opening situated facing the slit and, on the other hand, with an opening which is at least one of coincident or not coincident with the oblong opening, intended for the passage of a prong of an interconnection comb, wherein the conducting connecting piece is a connecting piece as claimed in claim 2.

17. A connecting device for at least one wire, comprising a conducting connecting piece with the insulation-displacement and retaining slit and an insulating casing having a housing in which the conducting connecting piece is immobilized, and provided, on the one hand, with a substantially parallel oblong opening situated facing the slit and, on the other hand, with an opening which is possibly coincident with the oblong opening, intended for the passage of a prong of an interconnection comb, wherein the conducting connecting piece is a connecting piece as claimed in claim 3.

18. A connecting device for at least one wire, comprising a conducting connecting piece with an insulation-displacement and retaining slit and an insulating casing having a housing in which the conducting connecting piece is immobilized, and provided, on the one hand, with a substantially parallel oblong opening situated facing the slit and, on the other hand, with an opening which is at least one of coincident or not coincident with the oblong opening, intended for the passage of a prong of an interconnection comb, wherein the conducting connecting piece is a connecting piece as claimed in claim 4.

19. A connecting device for at least one wire, comprising a conducting connecting piece with an insulation-displacement and retaining slit and an insulating casing having a housing in which the conducting connecting piece is immobilized, and provided, on the one hand, with a substantially parallel oblong opening situated facing the slit and, on the other hand, with an opening which is at least one of coincident or not coincident with the oblong opening, intended for the passage of a prong of an interconnection comb, wherein the conducting connecting piece is a connecting piece as claimed in claim 5.

20. A connecting device for at least one wire, comprising a conducting connecting piece with an insulation-displacement and retaining slit and an insulating casing having a housing in which the conducting connecting piece is immobilized, and provided, on the one hand, with a substantially parallel oblong opening situated facing the slit and, on the other hand, with an opening which is at least one of coincident or not coincident with the oblong opening, intended for the passage of a prong of an interconnection comb, wherein the conducting connecting piece is a connecting piece as claimed in claim 6.

* * * * *